US007042411B2

(12) United States Patent
Yagi et al.

(10) Patent No.: US 7,042,411 B2
(45) Date of Patent: May 9, 2006

(54) TRIAXIAL ANTENNA COIL

(75) Inventors: Masayoshi Yagi, Tsurugashima (JP); Shin Murakami, Tsurugashima (JP)

(73) Assignee: Toko Kabushiki Kaisha, (JP)

( * ) Notice: Subject to any disclaimer, the term of this patent is extended or adjusted under 35 U.S.C. 154(b) by 0 days.

(21) Appl. No.: 10/964,033

(22) Filed: Oct. 12, 2004

(65) Prior Publication Data

US 2005/0083242 A1 Apr. 21, 2005

(30) Foreign Application Priority Data

Oct. 20, 2003 (JP) ..... 2003-358709

(51) Int. Cl.
*H01Q 7/08* (2006.01)

(52) U.S. Cl. ..... 343/788; 343/787

(58) Field of Classification Search ..... 343/788, 343/787

See application file for complete search history.

(56) References Cited

U.S. PATENT DOCUMENTS

| | | | | |
|---|---|---|---|---|
| 6,563,474 | B1 * | 5/2003 | Nantz et al. | 343/788 |
| 6,924,767 | B1 * | 8/2005 | Kitahara et al. | 343/702 |
| 2004/0061660 | A1 * | 4/2004 | Yoshida et al. | 343/788 |

FOREIGN PATENT DOCUMENTS

| | | |
|---|---|---|
| DE | 195 33 105 | 10/1996 |
| JP | 2003092509 | 3/2003 |

* cited by examiner

*Primary Examiner*—Hoang V. Nguyen
(74) *Attorney, Agent, or Firm*—Renner, Kenner, Greive, Bobak, Taylor & Weber

(57) ABSTRACT

A triaxial antenna coil prevents wires from snapping, increases productivity, is resilient against dropping, and is suitable for being made small and light. A triaxial antenna coil includes coils, that are wound around three intersecting winding axes, and a flat core having winding grooves in three intersecting axial directions. A base has a terminal element, that is fitted with a plurality of external connectors and terminal connectors of windings. The base is fixed to one face of the core. The coils are wound in respective winding grooves, and their terminals are connected to the terminal connectors of the terminal element.

5 Claims, 3 Drawing Sheets

TRIAXIAL ANTENNA COIL

BACKGROUND OF THE INVENTION

1. Field of the Invention

The present invention relates to a small-scale triaxial antenna coil, that is used in a receiver or the like of a radio-controlled keyless entry system and a crime-prevention device.

2. Description of the Related Art

An antenna coil is used in a receiver or the like of a keyless entry system and a crime-prevention device, that are widely used in vehicles and the like. Recently, instead of a conventional antenna coil that includes a plurality of rod-like ferrite cores with windings around them for receiving waves in their respective directions, there is being used a miniaturized triaxial antenna coil that is installed in one part of a miniaturized receiving apparatus and can receive waves in all directions, as shown in FIGS. 4 and 5.

FIG. 4 is a perspective view of a conventional antenna coil, and FIG. 5 is a perspective view of the coil section of FIG. 4 (Cf. Japanese Laid-Open Patent Application No. 2003-92509). This antenna coil includes a core 15, comprised of ferrite and formed in a flattened drum-like shape, a first coil 25, wound around the Y-axis of the core 15, a second coil 26, wound around the X-axis of the core 15, and a third coil 27, wound around the Z-axis of the core 15. Wind grooves 21, 22, and 23, are provided in the sections where the first, second, and third coils are wound.

As shown in FIG. 4, the coil 20 that is wound in this manner is stored in a resin case 28 having four external terminals 29 on two opposing faces. Three winding terminals of the coil 20 are electrically connected to specified external terminals.

In conventional antenna coils such as that described above, when winding the first, second, and third coils, the terminal of the winding that was wound first must be momentarily held in another position while the next winding is wound. This operation is complex, and the winding terminals sometimes snap. In the assembly process of storing the coil 20 in the case 28, each winding terminal must be connected to an external terminal, leading to problems such as snapping and the like during binding, and increasing the number of necessary operations. Connecting electrodes directly to the faces of a core that does not use a case results in problems of high deterioration in Q caused by the electrode faces, the electrodes peel off easily, and core loss on the electrode faces.

SUMMARY OF THE INVENTION

The present invention has been realized in order to solve the problems of conventional antenna coils such as the above, and aims to provide a triaxial antenna coil that prevents snapping, increases productivity, is resilient against dropping, and suitable for being made small and light.

In order to achieve the above objects, this invention provides a triaxial antenna coil having coils that are wound around three intersecting axes. The triaxial antenna coil includes a flat core having winding grooves in three intersecting axial directions, and a base having a terminal element, that is fitted with a plurality of external connectors and terminal connectors of windings. The base is fixed to one face of the core, the coils are wound in respective winding grooves, and their terminals are connected to the terminal connectors of the terminal element.

According to the triaxial antenna coil of this invention, a flat core has winding grooves in three intersecting axial directions, and is fixed to an insulating resin base, that has a terminal connector for external connectors and windings. Consequently, in a winding process, an operation of binding the windings and post-winding winding terminals to the terminal connectors can be performed in a single series of operations. This enables other subsequent winding operations to be performed without considering the winding terminals that were wound earlier, and in addition, eliminates operations that may result in snapped wires, thereby increasing productivity. Furthermore, by arranging the plurality of external connectors at approximately equal intervals around the outer periphery of the side faces of the base, the triaxial antenna coil is made more resilient against dropping when mounted, and against peeling of electrodes or the like.

It is an object of this invention to provide a triaxial antenna coil that prevents wires from snapping, increases productivity, is resilient against dropping, and is suitable for being made small and light. The triaxial antenna coil has coils that are wound around three intersecting axes, and includes a flat core having winding grooves in three intersecting axial directions, and a base having a terminal element, that is fitted with a plurality of external connectors and terminal connectors of windings. The base is fixed to one face of the core, the coils are wound in respective winding grooves, and their terminals are electrically connected to the terminal connectors of the terminal element.

PREFERRED EMBODIMENT

A preferred embodiment of this invention will be explained based on FIGS. 1 to 3.

Figure 1A:
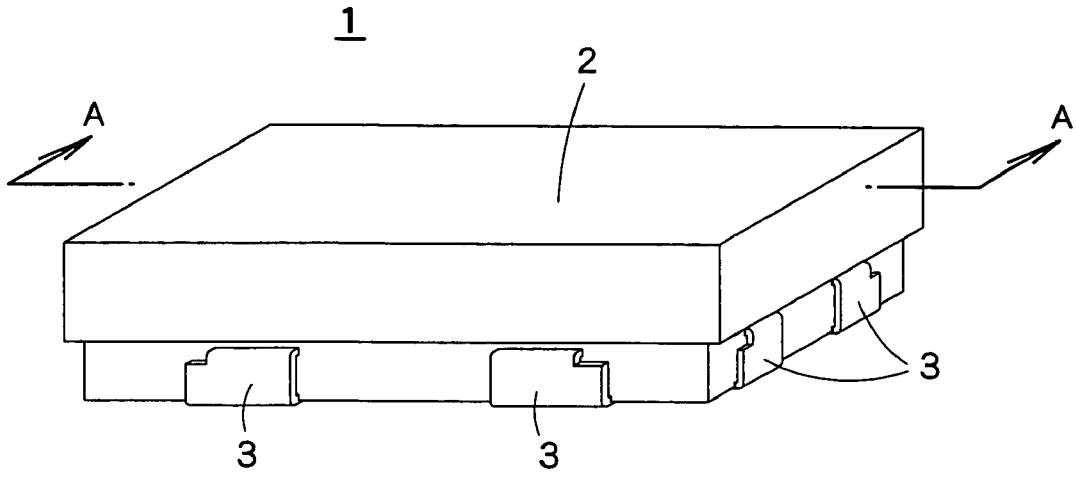
FIG. 1A is a perspective view of a triaxial antenna coil according to an embodiment of this invention.
Figure 1B:
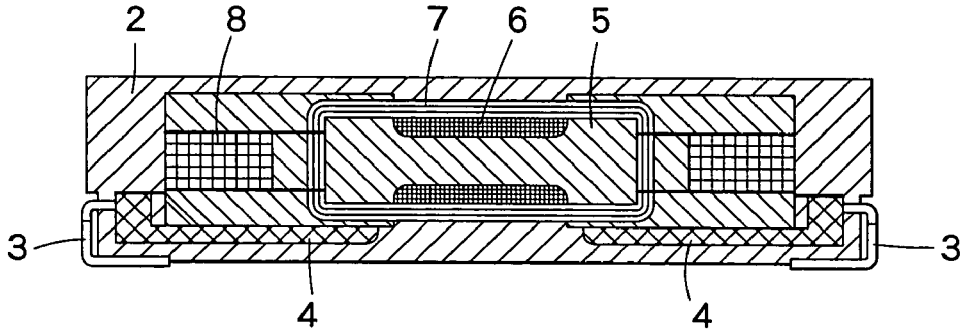
FIG. 1B is a cross-sectional view taken along the line A—A of FIG. 1A.

FIG. 1A is a perspective view of the triaxial antenna coil according to an embodiment of this invention, and FIG. 1B is a cross-sectional view taken along the line A—A of FIG. 1A. FIG. 2 is a perspective view of a core. FIG. 3A is a perspective view of a coil that is wound around a core, and FIG. 3B is a bottom view of the same.

As shown in FIGS. 1A and 1B, the triaxial antenna coil 1 according to the embodiment of this invention includes an outer resin 2, external terminals 3, a base 4, a core 5, a first coil 6, a second coil 7, and a third coil 8.

The core 5 is entirely covered by the outer resin 2, and the eight external terminals 3 (four opposing each other on opposite sides) are extracted from the centers of the side faces and formed along the bottom face sides, where they function as external connectors. As shown in the cross-sectional view of FIG. 1B, on the inside of the triaxial antenna coil 1, the core 5 is affixed on top of the base 4, that has unillustrated binding terminals of a terminal connector that interlocks with the external terminals 3 from the bottom face side. The first coil 6, the second coil 7, and the third coil 8, are wound around three core form sections of the coil 5.

The constitutions of the core 5 and the base 4 will be explained.

Figure 2:
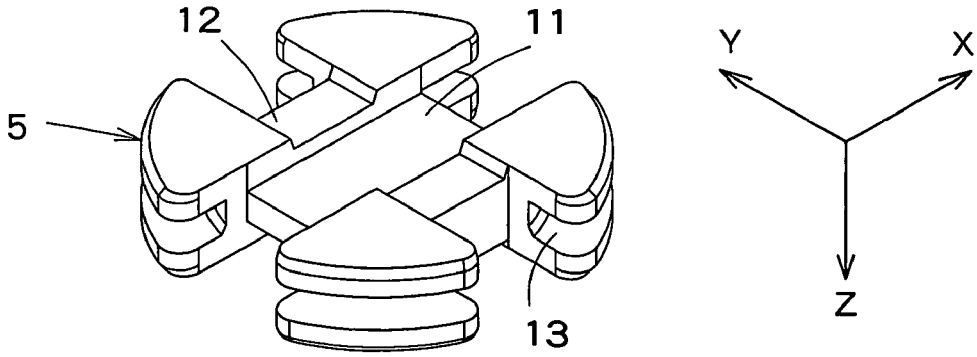
FIG. 2 is a perspective view of a core of the triaxial antenna coil used in this invention.
Figure 3A:
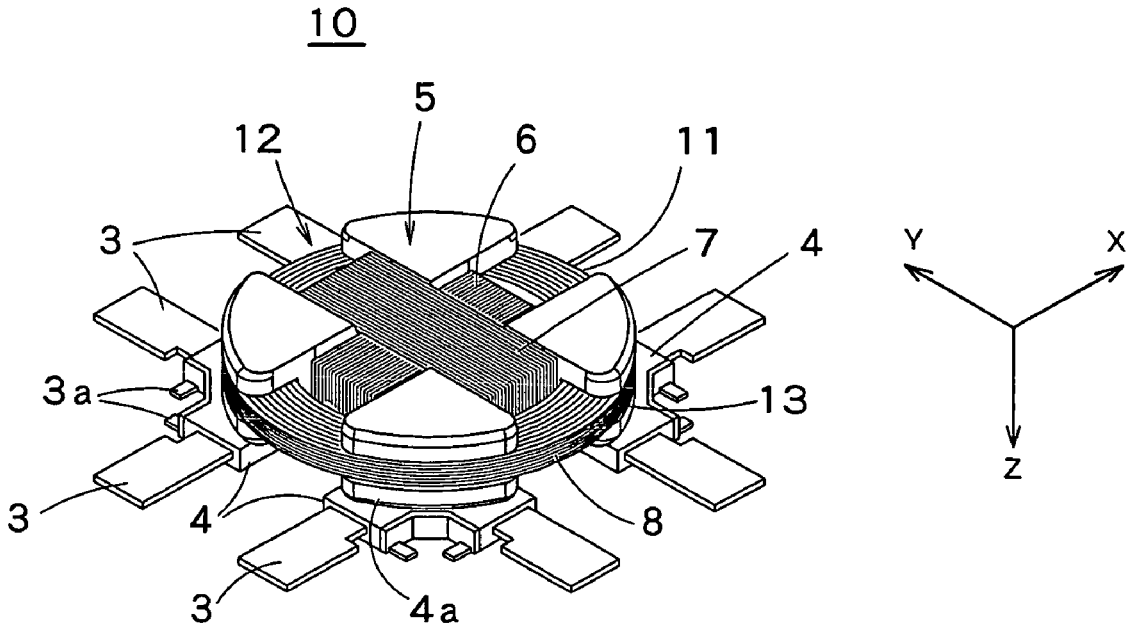
FIG. 3A is a perspective view of a winding section of the triaxial antenna coil of this invention.
Figure 3B:
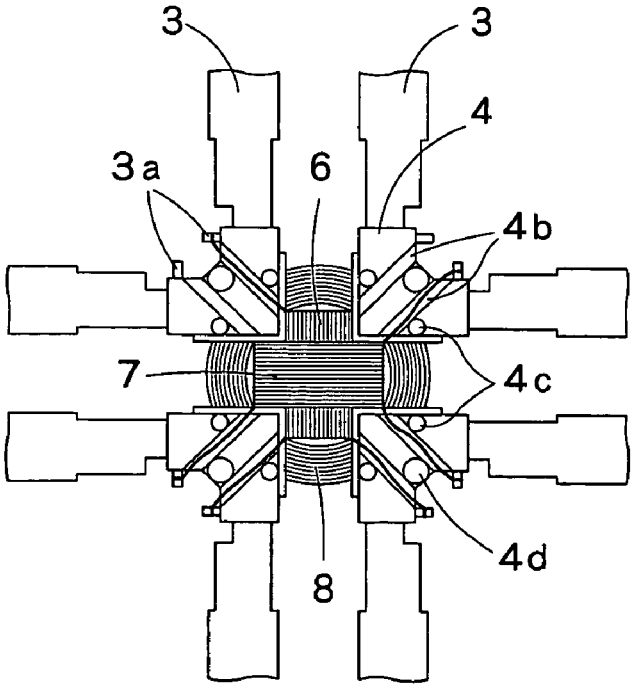
FIG. 3B is a bottom view of the same.
Figure 4:
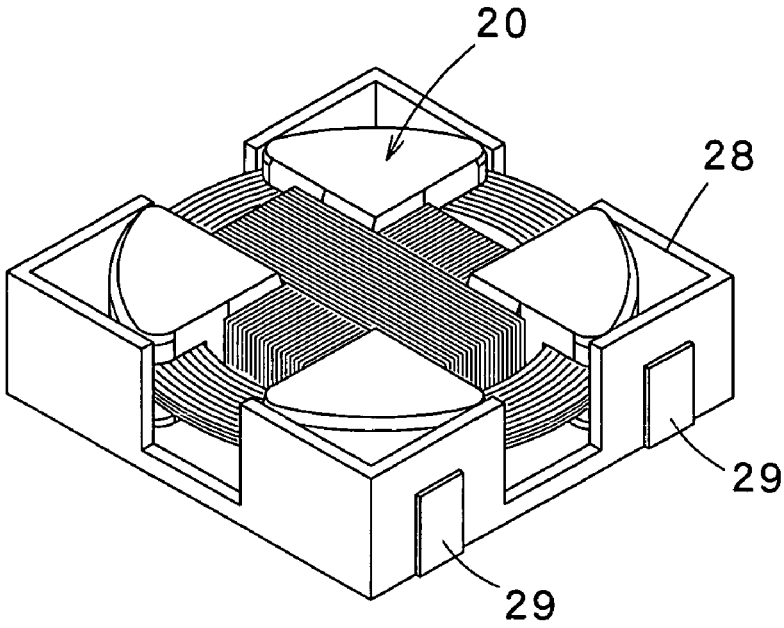
FIG. 4 is a perspective view of a conventional antenna coil.
Figure 5:
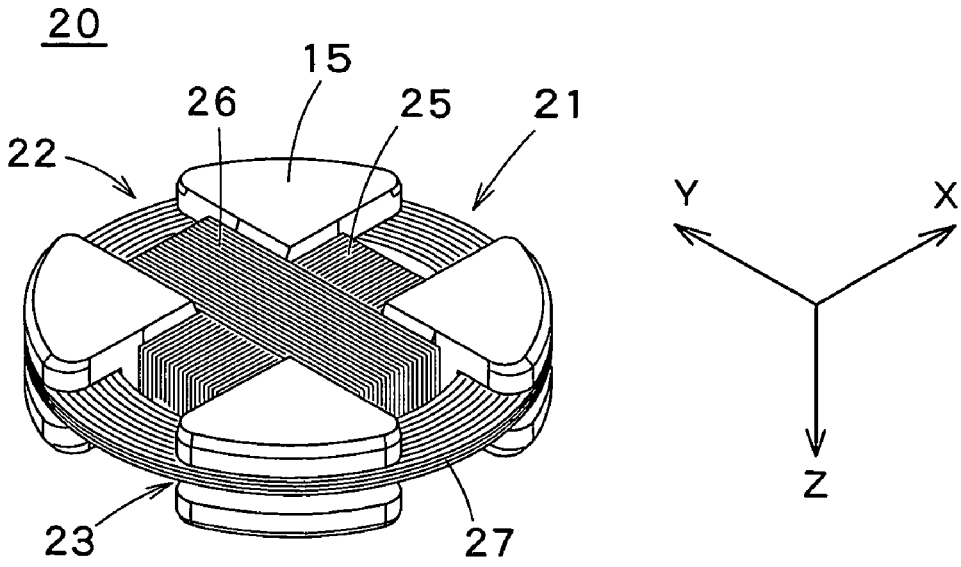
FIG. 5 is a perspective view of the winding state of a conventional antenna coil.

FIG. 2 is a perspective view of a core.

As shown in FIG. 2, the core 5 is comprised of ferrite and has a flattened drum-like shape. Around the outer periphery of the core, a winding groove 11 winds around the Y-axis direction of the core, and a winding groove 12 winds around the Z-axis of the core. The winding grooves 11 and 12 intersect at the center between the top and bottom faces of the core, and the winding groove 11 is deeper than the winding groove 12. In addition, a winding groove 13 winds around the Z-axis of the core around the outer periphery of the side face of the core.

FIG. 3A is a perspective view of a coil that is wound in a winding groove of a core, and FIG. 3B is a bottom view of the same.

As shown in FIGS. 3A and 3B, the eight external terminals 3 are arranged at approximately equal intervals symmetrical to the X-axis and the Y-axis, and have binding terminals 3*a* that extend at right angles to the long direction. A part of each external terminal 3 is molded from insulating resin, and forms the base 4. In the base 4, the external terminals 3 and binding terminals 3*a* are divided into four groups, each containing two external terminals 3 facing each other at right angles and two binding terminals 3*a*. An indentation 4*a* is provided on the top face of the base 4, and is approximately the same size as the outer periphery of the core 5. Interconnection grooves 4*b* are provided in the bottom face side of the base 4, and guide the winding terminals from the center of the resin section toward the binding terminals 3*a*. Protrusions 4*c* and 4*d* are provided at the ends of the interconnection grooves, as supplementary guides for the winding terminals.

The core 5 is aligned with the indentation 4*a* on the top face of the base 4, and the X-axis and Y-axis winding grooves of the core 5 are aligned with the part of the base 4 where the resin section is separated in the X-axis and Y-axis. These parts are then securely assembled together using adhesive.

The winding grooves 11 and 12 are provided so that the first coil and the second coil wind around the Y-axis and X-axis of the core 5. In this example, the winding groove 11 is deeper than the winding groove 12. The winding groove 13 is provided in the outer periphery of the core 5 so that the third coil 3 winds around the Z-axis. The first coil is wound in the winding groove 11, and terminals where the winding of the first coil begins and ends are bound to specific binding terminals along the interconnection grooves 4*b*, provided in the bottom face side of the base 4. The second coil is wound in the winding groove 12, and terminals where the winding of the second coil begins and ends are bound to specific binding terminals along the interconnection grooves, provided in the bottom face side of the base 4. The third coil is wound in the winding groove 13, and terminals where the winding of the third coil begins and ends are bound to specific binding terminals along the interconnection grooves 4*b*, provided in the bottom face side of the base 4. The terminals where winding begins may be bound to the binding terminals prior to winding.

The binding terminals, that the terminals of the three coils have been bound to, are electrically connected by laser welding. When the coils 10 have been wound around the core 5 and connected in this way, the outer periphery is insert-molded from a heat-resistant resin having insulating properties, with the exception of one section of the heads of the external terminals. The unmolded sections of the external terminals are formed along the bottom face from the side face, obtaining the surface-mounted terminals shown in FIG. 1.

According to the triaxial antenna coil of this invention, a core form section of a core has three winding grooves so that three winding axes intersect, and the core is securely affixed to an insulating resin base, that is fitted with binding terminals and external terminals. This enables the operation of binding the windings and winding terminals to the binding terminals to be performed in a single series of operations during the winding process, so that other subsequent winding operations can be performed without considering the winding terminals that were wound earlier. This eliminates operations that may result in snapped wires, and increases productivity. The winding section can be protected by insert-molding the outer periphery of the coil from an exterior resin. Arranging the external terminals at approximately equal intervals along the outer periphery of the side faces of the base makes it possible to obtain a triaxial antenna coil that is resilient against dropping of the mount device. Moreover, the base structure can reduce deterioration of Q.

The triaxial antenna coil of this invention is not limited to the embodiment described above. For example, although the embodiment uses a flattened drum-like core, the core may be a flattened square-like shape. The embodiment has eight external terminals, consisting of two terminals in each of four directions, but there may alternatively be four external terminals, one in each direction. However, this would require some work to the coil connection.

What is claimed is:

1. A triaxial antenna coil having coils that are wound around three intersecting axes, the triaxial antenna coil comprising:

a flat core having winding grooves in three intersecting axial directions; and a base being worked into a continuous hoop of phosphor bronze and being continuously molded from a heat-resistant resin having insulating properties, the base having a terminal element that is fitted with a plurality of external connectors and terminal connectors of windings;

a face of the core being fixed to the base, the coils being wound in the winding grooves, respectively, and their terminals being connected to the terminal connectors of the terminal element.

2. A triaxial antenna coil having coils that are wound around three intersecting axes, the triaxial antenna coil comprising:

a flat core having winding grooves in three intersecting axial directions; and a base having a terminal element that is fitted with a plurality of external connectors and terminal connectors of windings, the plurality of external connectors and the terminal connectors of windings being arranged approximately evenly in eight positions around side faces of the base; a face of the core being fixed to the base, the coils being wound in the winding grooves, respectively, and their terminals being connected to the terminal connectors of the terminal element.

3. A triaxial antenna coil having coils that are wound around three intersecting axes, the triaxial antenna coil comprising:

a flat core having winding grooves in three intersecting axial directions;

a base having a terminal element, that is fitted with a plurality of external connectors and terminal connectors of windings;

the base being fixed to one face of the core, the coils being wound in respective winding grooves, and their terminals being connected to the terminal connectors of the terminal element;

an outer periphery being molded by using an exterior resin, and the external connectors being made by forming.

4. The triaxial antenna coil according to claim 3, wherein the base is continuously molded from a heat-resistant resin having insulating properties, and the plurality of external connectors and the terminal connectors of windings are worked into a continuous hoop of phosphor bronze.

5. The triaxial antenna coil according to claim 3, wherein the plurality of external connectors and the terminal connectors of windings are arranged approximately evenly in eight positions around side faces of the base.

* * * * *